United States Patent [19]

Burg

[11] 4,031,972

[45] June 28, 1977

[54] EXPANDABLE AND CONTRACTIBLE ROTARY WELL DRILLING BIT

[76] Inventor: Irving X. Burg, 2301 Bayside Drive, Corona del Mar, Calif. 92625

[22] Filed: Mar. 8, 1976

[21] Appl. No.: 664,960

[52] U.S. Cl. ..... 175/263

[51] Int. Cl.[2] ..... E21B 9/26

[58] Field of Search ... 175/257, 258, 263, 266–271

[56] References Cited

UNITED STATES PATENTS

| | | | |
|---|---|---|---|
| 1,428,774 | 9/1922 | Gardner | 175/263 |
| 1,571,309 | 2/1926 | Wall | 175/263 |
| 2,705,129 | 3/1955 | Menton et al. | 175/263 |
| 2,822,150 | 2/1958 | Muse et al. | 175/266 |
| 3,817,339 | 6/1974 | Furse | 175/271 |

*Primary Examiner*—James A. Leppink
*Attorney, Agent, or Firm*—Harris, Kern, Wallen & Tinsley

[57] ABSTRACT

A rotary drill bit which is contractible to fit within a casing to permit withdrawal through the casing, and which is expandable below the casing to drill a well bore of a diameter larger than the outside diameter of the casing so as to permit the casing to follow the bit as drilling progresses to prevent the collapse of the well bore thereabove. The drill bit includes a base having pivotally mounted thereon a plurality, e.g., three, circumferentially spaced cutter arms, the cutter arms being pivotable inwardly and outwardly between retracted positions corresponding to the contracted condition of the bit and extended positions corresponding to the expanded condition of the bit. Stops are provided for preventing outward pivotal movement of the cutter arms beyond their extended positions and inward pivotal movement beyond their retracted positions, certain of these stops carrying the drilling load so that no substantial loads are applied to the pivot pin. Fluid passages in the base flush cuttings from the stops.

4 Claims, 4 Drawing Figures

EXPANDABLE AND CONTRACTIBLE ROTARY WELL DRILLING BIT

BACKGROUND OF THE INVENTION

The present invention relates in general to the well drilling art and, more particularly, to the art of rotary well drilling.

The conventional practice in rotary well drilling is to install a casing after the well bore has been completed. When drilling through unconsolidated formations, this practice frequently results in lost circulation during drilling, sticking of the drill bit during drilling, sticking of the casing upon insertion thereof into the well bore after completion of drilling, and the like. Occasionally, problems arise which necessitate abandoning the hole and starting over.

The present invention overcomes difficulties of the foregoing nature by installing the casing in the well bore as the hole is being drilled. More particularly, the present invention contemplates a rotary drill bit which is contractible to fit within a casing to permit withdrawal thereof through the casing, and which is expandable below the casing to drill a well bore of a diameter larger than the outside diameter of the casing so as to permit the casing to follow the bit closely during drilling, thereby eliminating such problems as lost circulation, sticking of the drill bit, collapsing of the well bore above the drill bit, and the like. Whenever it is necessary to withdraw the drill bit from the hole to change it, the bit can be contracted readily to permit withdrawal thereof through the casing. In running a new drill bit in, the bit is expanded below the casing to continue drilling a hole larger than the outside diameter of the casing.

Relevant prior art known to me includes the following U.S. patents:

U.S. Pat. No. 1,585,540; Dougherty; U.S. Pat. No. 1,607,791, Dougherty; U.S. Pat. No. 2,193,721, Gunderson; U.S. Pat. No. 2,330,083, Sewell; U.S. Pat. No. 2,705,129, Menton et al.; U.S. Pat. No. 2,978,047; De Vann; U.S. Pat. No. 3,077,235, Govin; U.S. Pat. No. 3,545,553; Kammerer, Jr. et. al.; U.S. Pat. No. 3,552,508, Brown; U.S. Pat. No. 3,664,755, Carns.

Many of the foregoing patents disclose rotary drilling systems wherein the bit is contractible for withdrawal through a casing or drill string, but wherein the casing or drill string rotates with the drill bit, in most instances to drive it. Such rotation of the casing can result in considerable wear thereof during the drilling operation. In other instances, means must be provided for expanding and/or contracting the bit, such means being run in from the surface whenever expansion or contraction of the bit is desired. Still others utilize cutter arm pivots which are required to carry the drilling load, which is undesirable, and/or utilize a single pivot for a plurality of cutter arms, which is also undesirable.

OBJECTS AND SUMMARY OF THE INVENTION

A general object of the invention is to provide a rotary drill bit, capable of contraction for withdrawal through a casing, and capable of expansion to a diameter larger than the outside diameter of the casing, which incorporates improvements on the drill bits hereinbefore outlined.

More particularly, an important object of the invention is to provide a rotary drill bit which is driven in the conventional manner by a rotary drill string which extends downwardly from the surface through a nonrotating casing capable of closely following the bit.

Another important object is to provide a drill bit which automatically expands in response to the application of part or all of the drill string weight thereto, and which automatically contracts for withdrawal through the casing upon upward movement of the bit off the bottom of the hole, no auxiliary means for expanding or contracting the bit being required.

Yet another object is to provide interengageable stop means on the base and the cutter arms for preventing outward pivotal movement of the cutter arms beyond their extended positions corresponding to the expanded position of the bit and for preventing inward pivotal movement of the cutter arms beyond their retracted positions corresponding to the contracted condition of the bit.

Still another and important object of the invention is to provide large area stop means, limiting outward pivotal movement of the cutter arms, which transmit the drill string weight to the cutter arms without applying any substantial loads to independent pivot pins for the respective cutter arms.

Another object is to provide fluid passage means in the base and communicating with the drill string for flushing cuttings from the various interengageable stop means.

The invention may be summarized as comprising, and another object of the invention is to provide a rotary drill bit which includes: a base having an upper end threaded for connection to the lower end of a rotary drill string in the casing for driving the bit; a plurality of cutter arms circumferentially spaced around the base therebelow and respectively having cutters thereon; a plurality of pivot pins respectively pivotally connecting the cutter arms to the base for simple pivotal movement inwardly and outwardly between retracted positions corresponding to the contracted condition of the bit and extended positions corresponding to the expanded condition of the bit, the pivot pins having circular cross sections and being disposed in holes of circular cross section in the base and the cutter arms, respectively; a plurality of interengageable expansion stop means on the base and on the cutter arm, respectively, for preventing outward pivotal movement of the cutter arms beyond their extended positions corresponding to the expanded condition of the bit and for transferring the weight of the base and the drill string to the cutter arms without applying any substantial loads to the pivot pins; and a plurality of interengageable contraction stop means on the base and on the cutter arms, respectively, or preventing inward pivotal movement of the cutter arms beyond their retracted positions corresponding to the contracted condition of the bit, the expansion stop means limiting inward pivotal movement of the cutter arms to values such that the weight of the base and the drill string pivots the cutter arms outwardly into their extended positions, to expand the bit, when the cutters rest on the bottom of the well bore.

Still another object of the invention is to provide a rotary drill bit wherein each interengageable expansion stop means includes: a first set of interengageable expansion stops on the base and the corresponding cutter arm adjacent one end of the corresponding pivot pin and below and radially outwardly of the corresponding pivot pin; a second set of interengageable expansion stops on the base and the corresponding cutter arm adjacent the other end of the corresponding pivot pin and below and radially outwardly of the corresponding pivot pin; and a third set of interengageable expansion stops on the base and the corresponding cutter arm intermediate the ends of the corresponding pivot pin and above and radially outwardly of the corresponding pivot pin.

An additional object of the invention is to provide a rotary drill bit wherein each interengageable contraction stop means includes: a set of interengageable contraction stops on the base and on the corresponding cutter arm adjacent one end of the corresponding pivot pin and radially inwardly of the corresponding pivot pin; and another set of interengageable contraction stops on the base and on the corresponding cutter arm adjacent the other end of the corresponding pivot pin and radially inwardly of the corresponding pivot pin.

The foregoing objects, advantages, features and results of the present invention, together with various other objects, advantages, features and results thereof which will be evident to those skilled in the rotary drilling art in the light of this disclosure, may be achieved with the exemplary embodiment of the invention illustrated in the accompanying drawings and described in detail hereinafter.

DESCRIPTION OF EXEMPLARY EMBODIMENT OF INVENTION

Figure 1:
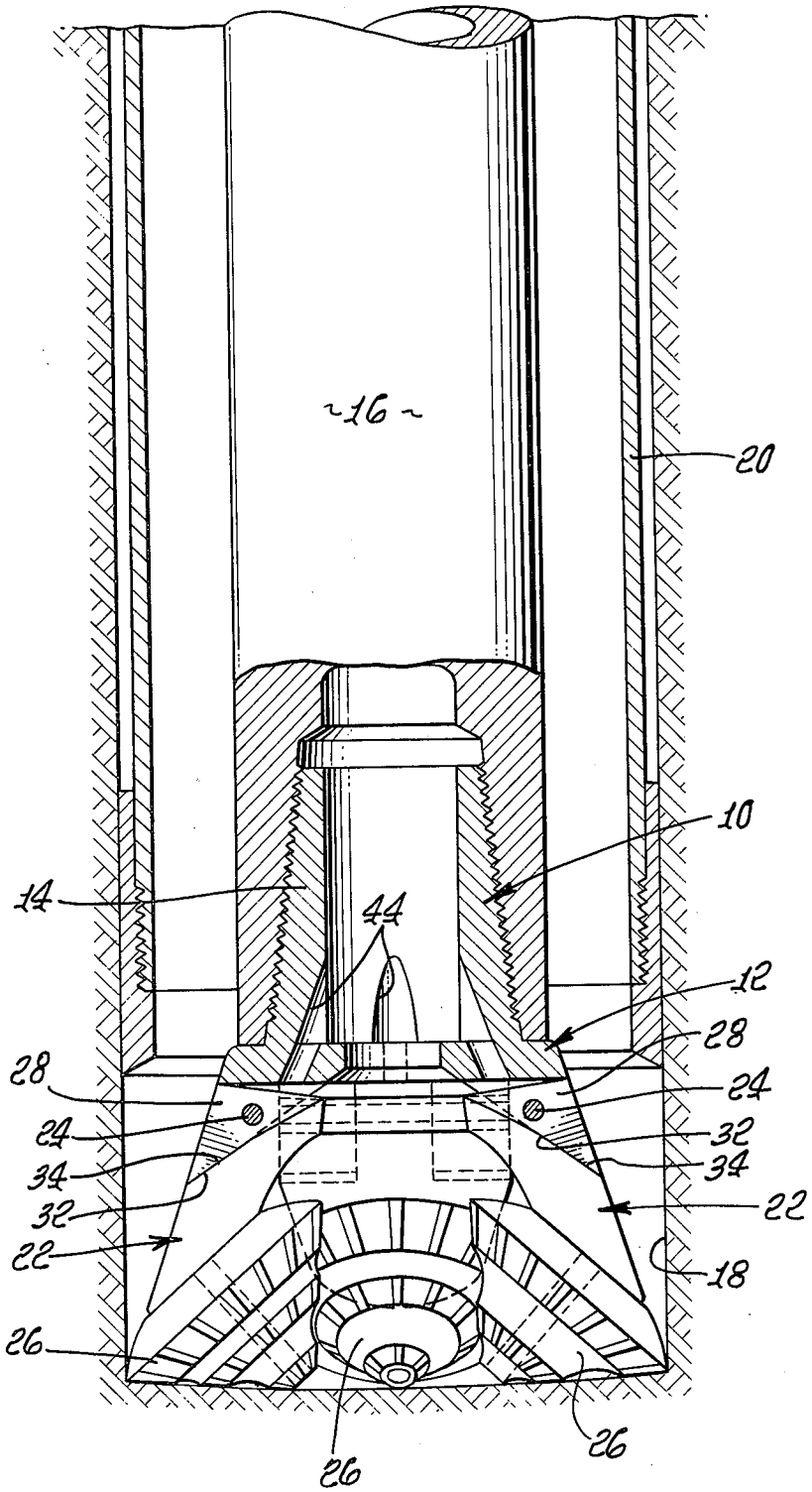
FIG. 1 is a vertical sectional view of a rotary drill bit of the invention in an expanded condition to drill a well bore below a following casing, the well bore diameter being larger than the outside casing diameter.

Referring to the drawings, the rotary drill bit of the invention is designated generally by the numeral 10 and includes a base or body 12 having its upper end 14 threaded for connection to the lower end of a conventional rotary drill string 16. The numeral 18 designates a well bore or hole drilled by the bit 10 and provided with a casing 20. During drilling, drilling mud or other fluid is circulated down the drill string 16 and up the annulus between the drill string and the well casing 20 in the conventional manner.

Figure 2:
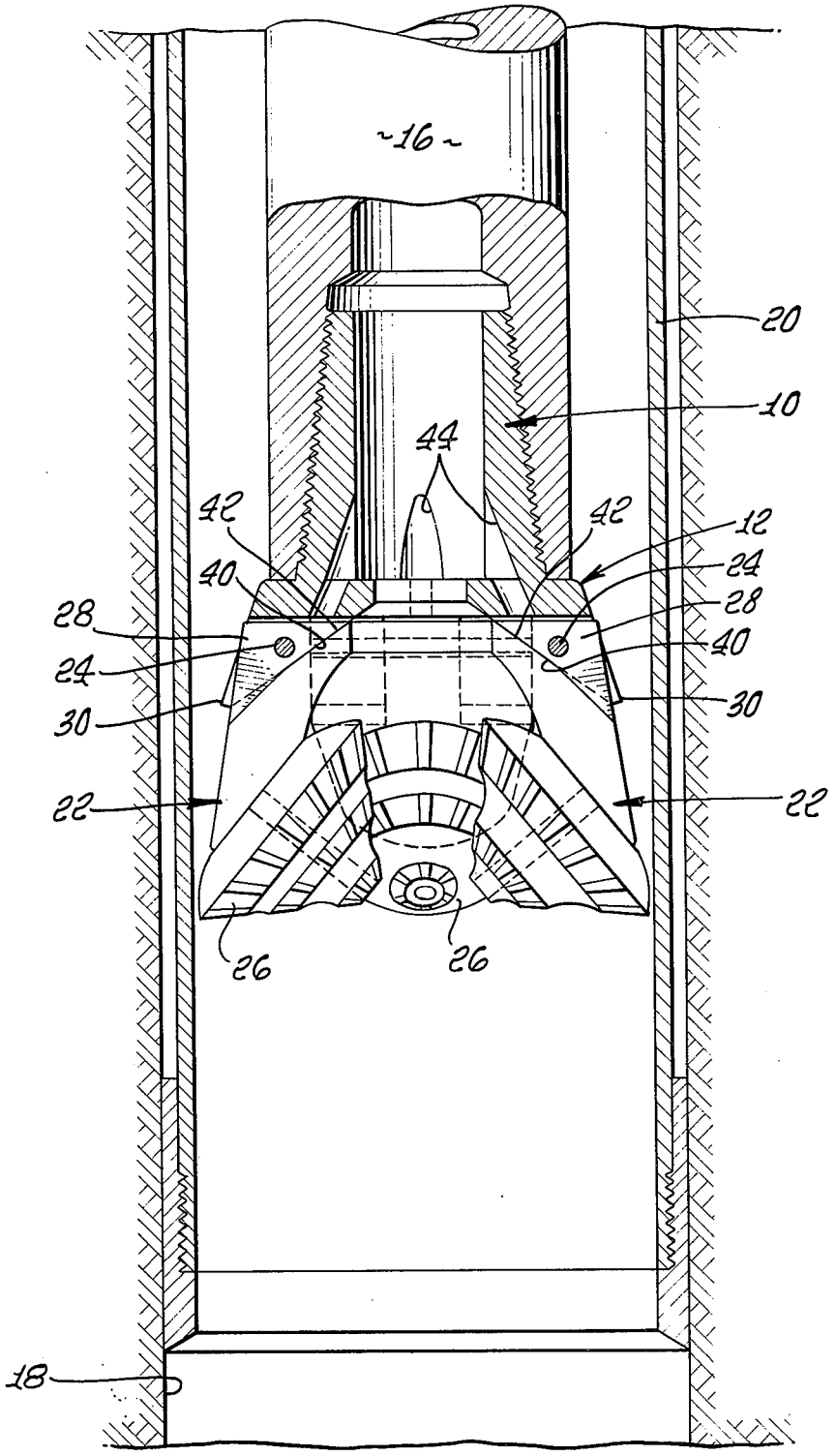
FIG. 2 is a view similar to FIG. 1, but showing the drill bit of the invention contracted for withdrawal upwardly through the casing.

The rotary drill bit 10 is expandable and contractible, being shown in its expanded condition in FIG. 1 of the drawings, and in its contracted condition in FIG. 2 thereof. When expanded, the drill bit 10 drills the hole 18 to a diameter larger than the outside diameter of the casing 20 so that the casing can follow the drill bit closely, as shown in FIG. 1, to prevent the collapse of the well bore thereabove. When it is desired to withdraw the rotary drill bit 10, it is contracted to a diameter smaller than the inside diameter of the well casing 20, as shown in FIG. 2, so that the bit can be run out through the casing. As will be explained hereinafter, the drill bit 10 of the invention expands automatically to the diameter of the well bore 18 when part or all of the weight of the drill string 16 is applied thereto. Upon lifting the drill bit 10 of the invention off bottom, it automatically contracts, as shown in FIG. 2. Thus, no auxiliary means for expanding and/or contracting the drill bit 10 are required.

Considering the rotary drill bit 10 of the invention in more detail now, a plurality, e.g., three, cutter arms 22 are located below the case 12 and circumferentially spaced around the axis of the bit. A plurality, e.g., three, pivot pins 24 respectively pivotally connect the cutter arms 22 to the base for simple pivotal movement inwardly and outwardly between retracted positions corresponding to the contracted condition of the bit, FIG. 2, and extended positions corresponding to the expanded condition of the bit, FIGS. 1 and 3. The pivot pins are cylindrical and are disposed in holes of circular cross section in the base 12 and the cutter arms 22, as will be described in more detail hereinafter. Each cutter arm 22 is shown as carrying a conventional rotary cutter 26. However, it will be understood that the cutter arms 22 may carry, or be formed with, cutters of types other than the one shown, depending on the formation to be drilled.

Figure 3:
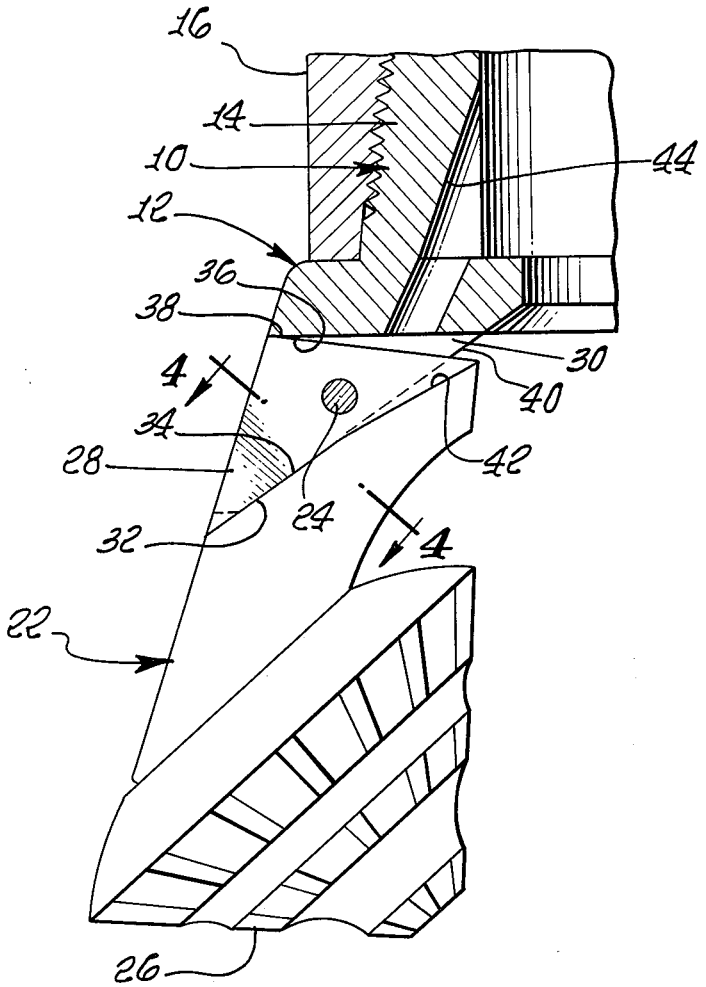
FIG. 3 is an enlarged view similar to a portion of FIG. 1.
Figure 4:
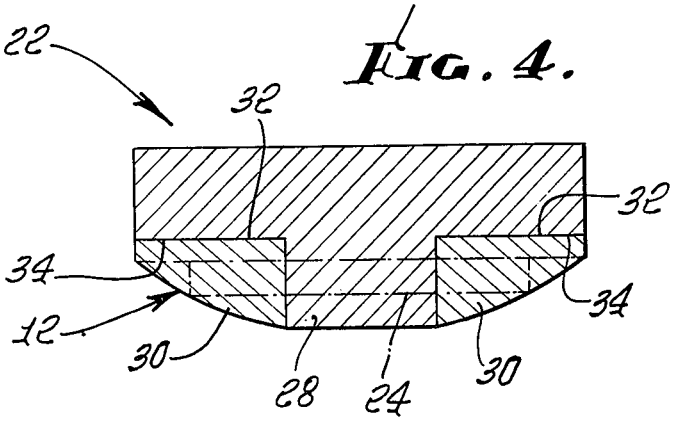
FIG. 4 is a fragementary sectional view taken as indicated by the arrowed line 4—4 of FIG. 3 of the drawings.

The pivotal interconnections between the cutter arms 22 and the base 12 are identical so that only one of them will be considered in detail, with particular reference to FIGS. 3 and 4 of the drawings. Each cutter arm 22 is provided with an ear 28 which is inserted between spaced ears 30 on the base 12. The corresponding pivot pin 24 extends through one of the ears 30 on the base, the ear 28 on the cutter arm, and the other ear 30 on the base.

The base 12 and each cutter arm 22 are provided with interengageable expansion stop means for preventing outward pivotal movement of the cutter arm beyond its extended position, corresponding to the expanded condition of the bit 10, and are provided with interengageable contraction stop means for preventing inward pivotal movement of the cutter arm beyond its retracted position, corresponding to the contracted position of the bit. These stop means are identical for all of the cutter arms 22 so that they will be considered in connection with one cutter arm only, with particular reference to FIGS. 3 and 4.

Considering the interengageable expansion stop means, it includes two sets of interengageable, large-area expansion stops 32 and 34 on the base 12 and the corresponding cutter arm 34. As best shown in FIG. 4, the two sets of expansion stops 32 and 34 are spaced apart axially of and located adjacent the ends of the corresponding pivot pin 24. It will be noted that the two sets of expansion stops 32 and 34 are located generally below the corresponding pivot pin 24, and are located generally radially outwardly thereof with respect to the axis of the drill bit 10.

Between the two sets of expansion stops 32 and 34 is another set of expansion stops 36 and 38 on the base 12 and the corresponding cutter arm 22, these being located generally above and radially outwardly of the corresponding pivot pin 24. It will be noted that the expansion stops 36 and 38 are circumferentially spaced from the two sets of expansion stops 32 and 34 about the axis of the corresponding pivot pin 24.

It will be noted that when the two sets of expansion stops 32 and 34 are interengaged, and the intervening expansion stops 36 and 38 are interengaged, there is substantially no load on the corresponding pivot pin 24, engagement of the intermediate stop 38 with its complementary stop 36 preventing any tendency of the cutter arm 22 to slide upwardly and inwardly along the large-area stops 32.

Since the pivot pins 24 are subjected to substantially no load when the cutter arms 22 are in their extended positions, as shown in FIGS. 1 and 3, substantially none of the drilling load on the cutters 26 is carried by the pins. Consequently, they may be made readily removable for the purpose of changing the cutter arms 22 whenever the cutters 26 become worn, something which can be done readily in the field.

It will be noted that when the drill bit 10 is landed on bottom, as shown in FIG. 1, the weight of the bit and the drill string 16 thereabove automatically causes the cutter arms 22 to pivot outwardly into the extended position of the cutter arms, thereby bringing the stops 32 and 34 and the stops 36 and 38 into interengagement. In other words, the expansion of the drill bit 10 is automatic, no auxiliary means for expanding same being necessary.

Similarly, the centers of gravity of the cutter arms 22, and the cutters 26 thereon, are so located that when the drill bit 10 is lifted off bottom, the cutter arms 22 automatically swing inwardly into retracted positions corresponding to the contracted condition of the bit, as shown in FIG. 2, no auxiliary contracting means being necessary. To prevent inward pivoting of the cutter arms 22 beyond their retracted positions, the aforementioned interengageable contraction stop means includes two sets of interengageable contraction stops 40 and 42 on the base and the corresponding cutter arm, respectively, the two sets respectively being located adjacent the ends of the corresponding pivot pin 24 and radially inwardly of the corresponding pivot pin, relative to the drill bit axis. As will be apparent from FIG. 3 in particular, engagement of the various stops 42 within the corresponding stop 40 limits inward pivoting of the cutter arms 22, such inward pivoting occurring automatically to automatically contract the bit, when it is lifted off bottom.

The base 12 of the drill bit 10 is provided with fluid passages 44 which extend outwardly and downwardly from the interior of the base to direct drilling fluid from the drill string 16 at the various stops 32, 34, 36, 38, 40 and 42 to flush cuttings therefrom so that such cuttings will not interfere with automatic expansion and/or contraction of the drill bit.

Although an exemplary embodiment of the invention has been disclosed for illustrative purposes, it will be understood that various minor changes, modifications and substitutions may be incorporated in such embodiment without departing from the invention as hereinafter claimed.

I claim as my invention:

1. In a rotary drill bit which is contractible to fit within a casing to permit withdrawal through the casing, and which is expandable below the casing to drill a well bore of a diameter larger than the outside diameter of the casing so as to permit the casing to follow the bit to prevent collapse of and/or lost circulation from the well bore thereabove, the combination of:

a. a base having an upper end threaded for connection to the lower end of a rotary drill string in the casing for driving the bit;

b. a plurality of cutter arms circumferentially spaced around said base therebelow and respectively having cutters thereon;

c. a plurality of pivot pins respectively pivotally connecting said cutter arms to said base for simple pivotal movement inwardly and outwardly between retracted positions corresponding to the contracted condition of the bit and extended positions corresponding to the expanded condition of the bit, said pivot pins having circular cross sections and being disposed in holes of circular cross section in said base and said cutter arms, respectively;

d. a plurality of interengageable expansion stop means on said base and on said cutter arms, respectively, for preventing outward pivotal movement of said cutter arms beyond their extended positions corresponding to the expanded condition of the bit and for transferring the weight of said base and the drill string to said cutter arms without applying any substantial loads to said pivot pins, each of said interengageable expansion stop means including a first set of interengageable expansion stops on said base and the corresponding cutter arm adjacent one end of the corresponding pivot pin and below and radially outwardly of the corresponding pivot pin, a second set of interengagable expansion stops on said base and the corresponding cutter arm adjacent the other end of the corresponding pivot pin and below and radially outwardly of the corresponding pivot pin, and a third set of interengageable expansion stops on said base and the corresponding cutter arm intermediate the ends of the corresponding pivot pin and above and radially outwardly of the corresponding pivot pin; and e. a plurality of interengageable contraction stop means on said base and on said cutter arms, respectively, for preventing inward pivotal movement of said cutter arms beyond their retracted positions corresponding to the contracted condition of the bit, said expansion stop means limiting inward pivotal movement of said cutter arms to values such that the weight of said base and the drill string pivots said cutter arms outwardly into their extended positions, to expand the bit, when said cutters rest on the bottom of said well bore.

2. A rotary drill bit as defined in claim 1 wherein each of said interengageable contraction stop means includes:

a. a set of interengageable contraction stops on said base and on the corresponding cutter arm adjacent one end of the corresponding pivot pin and radially inwardly of the corresponding pivot pin; and b. another set of interengageable contraction stop on said base and on the corresponding cutter arm adjacent the other end of the corresponding pivot pin and radially inwardly of the corresponding pivot pin.

3. In a rotary drill bit which is contractible to fit within a casing to permit withdrawal through the casing, and which is expandable below the casing to drill a well bore of a diameter larger than the outside diameter of the casing so as to permit the casing to follow the bit to prevent collapse of and/or lost circulation from the well bore thereabove, the combination of:

a. a base having an upper end threaded for connection to the lower end of a rotary drill string in the case for driving the bit;

b. a plurality of cutter arms circumferentially spaced around said base therebelow and respectively having cutters thereon;

c. a plurality of pivot pins respectively pivotally connecting said cutter arms to said base for simple pivotal movement inwardly and outwardly between retracted positions corresponding to the contracted condition of the bit and extended positions corresponding to the expanded condition of the bit, said pivot pins having circular cross sections and being disposed in holes of circular cross section in said base and said cutter arms, respectively;

d. a plurality of interengageable expansion stop means on said base and on said cutter arms, respectively, for preventing outward pivotal movement of said cutter arms beyond their extended positions corresponding to the expanded condition of the bit and for transferring the weight of said base and the drill string to said cutter arms without applying any substantial loads to said pivot pins;

e. a plurality of interengageable contraction stop means on said base and on said cutter arms, respectively, for preventing inward pivotal movement of said cutter arms beyond their retracted positions corresponding to the contracted condition of the bit, said expansion stop means limiting inward pivotal movement of said cutter arms to values such that the weight of said base and the drill string pivots said cutter arms outwardly into their extended positions, to expand the bit, when said cutters rest on the bottom of the well bore; and f. each of said interengageable expansion stop means including at least two sets of interengageable expansion stops on said base and the corresponding cutter arm and circumferentially spaced apart about the axis of the corresponding pivot pin.

4. In a rotary drill bit which is contractible to fit within a casing to permit withdrawal through the casing, and which is expandable below the casing to drill a well bore of a diameter larger than the outside diameter of the casing so as to permit the casing to follow the bit to prevent collapse of and/or lost circulation from the well bore thereabove, the combination of:

a. a base having an upper end threaded for connection to the lower end of a rotary drill string in the casing for driving the bit;

b. a plurality of cutter arms circumferentially spaced around said base therebelow and respectively having cutters thereon;

c. a plurality of pivot pins respectively pivotally connecting said cutter arms to said base for simple pivotal movement inwardly and outwardly between retracted positions corresponding to the contracted condition of the bit and extended positions corresponding to the expanded condition of the bit, said pivot pins having circular cross sections and being disposed in holes of circular cross section in said base and said cutter arms, respectively;

d. a plurality of interengageable expansion stop means on said base and on said cutter arms, respectively, for preventing outward pivotal movement of said cutter arms beyond their extended positions corresponding to the expanded condition of the bit and for transferring the weight of said base and the drill string to said cutter arms without applying any substantial loads to said pivot pins;

e. a plurality of interengageable contraction stop means on said base and on said cutter arms, respectively, for preventing inward pivotal movement of said cutter arms beyond their retracted positions corresponding to the contracted condition of the bit, said expansion stop means limiting inward pivotal movement of said cutter arms to values such that the weight of said base and the drill string pivots said cutter arms outwardly into their extended positions, to expand the bit, when said cutters rest on the bottom of the well bore; and f. fluid passage means in said base and communicating with a drill string connected thereto for flushing cuttings from said interengageable stop means, said fluid passage means including a plurality of branch passages respectively leading directly to said interengageable stop means.

* * * * *